US005092706A

United States Patent [19]

Bowen et al.

[11] Patent Number: 5,092,706

[45] Date of Patent: Mar. 3, 1992

[54] TACK COMPOUNDS AND MICROWAVE METHOD FOR REPAIRING VOIDS IN ASPHALT PAVEMENT

[75] Inventors: Robert F. Bowen, Burlington; John S. Sklenak; Kenneth W. Dudley, both of Sudbury, all of Mass.

[73] Assignee: Raytheon Company, Lexington, Mass.

[21] Appl. No.: 602,843

[22] Filed: Oct. 24, 1990

[51] Int. Cl.[5] ..... E01C 7/06; E01C 3/00

[52] U.S. Cl. ..... 404/77; 404/31

[58] Field of Search ..... 404/77, 80, 81, 82, 404/31, 12, 14, 30, 28; 427/186, 29

[56] References Cited

U.S. PATENT DOCUMENTS

| | | | |
|---|---|---|---|
| 3,870,426 | 3/1975 | Kietzman et al. | 404/82 |
| 4,151,025 | 4/1979 | Jacobs | 404/31 |
| 4,234,639 | 11/1980 | Graham | 427/186 |
| 4,252,459 | 2/1981 | Jeppson | 404/77 |
| 4,252,487 | 2/1981 | Jeppson | 404/77 |
| 4,292,120 | 9/1981 | Nacci | 427/29 |
| 4,339,289 | 7/1982 | Lankard | 404/28 |
| 4,594,022 | 6/1986 | Jeppson | 404/31 |
| 4,744,693 | 5/1988 | Smith | 404/80 |

*Primary Examiner*—Ramon S. Britts
*Assistant Examiner*—Nancy P. Connolly
*Attorney, Agent, or Firm*—William R. Clark; Richard M. Sharkansky

[57] ABSTRACT

A method for repairing voids such as potholes in asphalt pavement by mixing a lossy microwave material in the tack used for the tack layer. The asphalt patch used to fill the pothole is relatively non-lossy so that a substantial portion of microwave energy applied to the upper surface penetrates through the asphalt patch and is absorbed in the tack layer. The heating of the tack layer is enhanced to improve the interface bond between the asphalt patch and the surface of the pothole.

13 Claims, 2 Drawing Sheets

TACK COMPOUNDS AND MICROWAVE METHOD FOR REPAIRING VOIDS IN ASPHALT PAVEMENT

BACKGROUND OF THE INVENTION

The field of the invention generally relates to repairing voids in asphalt pavement or surfaces, and more particularly relates to tack compounds and a method of repairing such asphalt pavement using microwave energy.

As is well known, asphalt materials are widely used for paving roadways, parking lots, pathways, and the like. In typical road construction, the roadway is prepared by laying a granular subbase of crushed stone or the like on compacted fill. Multiple layers or courses of asphalt material are then placed on the road bed. As each layer is applied, it is suitably leveled and compacted such as by a roller.

Asphalt material is typically a mixture of bitumen and stone commonly called aggregate that are heated and mixed together at a remote mixing plant. The hot mixture is then transported to the roadway and applied using paving machinery. The composition of each of the asphalt layers is dependent on the projected use of the roadway, but generally asphalt layers of coarse aggregate are applied first with a final or top layer of fine aggregate that is 2"-3" thick.

As is well known, asphalt pavement may be subject to localized erosion caused primarily by weather conditions and heavy traffic. Voids in asphalt pavement typically take the form of cracks or holes commonly referred to as potholes, and the depth of voids may be within the top layer or anywhere down through the coarse layers into the subbase. In the repair of roadways, it has been found beneficial to apply heat to the area being repaired during or after the repair operation. For example, a gas flame heater or a radiant heater may be used to heat the asphalt material and cause the material to soften. It has been found desirable to first spray a coating of hot tack into the pothole or crack before filling it with hot asphalt patch material. The tack serves as an adhesive interface and forms a bond between the patch material and the inner surface of the void. Unfortunately, most potholes evolve under weather conditions that are adverse to good bonding. For example, a roadbed surface in a northern state would likely be near freezing or below during winter; without adding considerable heat to the pothole, the spray of tack cools rapidly resulting in a poor quality bond.

Microwave energy has been used to heat asphalt material in situ (i.e. after being laid on the roadbed). For example, U.S. Pat. No. 4,594,022 to Jeppson describes the use of a sheet or layer of microwave reflective material such as a metal foil being applied below a top layer of asphalt material. The embedded sheet of metallic material acts as a microwave reflector to enhance the heating of the top layer of asphalt material. This is accomplished by reflection of the microwave energy from the metal foil layer. Jeppson teaches that microwave energy will typically penetrate into an asphalt material approximately 7-8". Although Jeppson's reflector is used to concentrate the microwave energy in the top layer, asphalt materials are still generally not very lossy; that is, asphalt materials are generally not readily susceptible to being heated by microwave energy.

In U.S. Pat. No. 4,849,020 to Osborne et al., lossy material is described being mixed with the asphalt material to provide a patch material that readily absorbs microwave energy and heats efficiently. Lossy microwave materials are those materials that absorb microwave energy by coupling with the electrical component, the magnetic component, or both components of the impinging microwave energy. The described lossy materials are semi-conductors, ferromagnetic materials, metal oxides, dielectric materials, metals in powder or particle form, and mixtures thereof. One drawback of this method is that when a large volume of asphalt is used, a proportionally large volume of lossy material such as ferrite is also required, and the cost may be high. Another drawback is that when a lossy material is mixed with the asphalt patch material, the depth of penetration is significantly reduced because the microwave energy is greatly attenuated by absorption near the surface of the pavement. As a result, the surface will get hot, but the region below the surface may stay cool. Accordingly, if the interface between the patch material and the roadbed is relatively deep, the tack layer may not heat effectively and a poor bond may result. Thus, the patch material may separate from the inner pothole surface. As often is the case, the patch material is then dislodged from the pothole by traffic, and the pothole returns to its original unrepaired form.

SUMMARY OF THE INVENTION

In accordance with the invention, a method is provided for repairing a void such as a pothole in asphalt pavement comprising the steps of mixing a lossy microwave material with a tack to form a lossy composite tack, applying the composite tack to the pothole to form a layer having a thickness less than 1", filling the pothole on top of the layer of lossy composite tack with an asphalt patch, and then applying microwave energy for a predetermined time period to the surface of the asphalt patch so that a substantial portion of the microwave energy penetrates through the asphalt patch and is absorbed by the lossy microwave material in the composite tack to heat the tack and form an interface bond between the asphalt patch and the inner surface of the pothole. Optionally, fibers may be added to the composite tack to provide mechanical strength, or alternately, the lossy microwave material may be in the form of fibers. In one preferred embodiment, the lossy microwave material is $Fe_3O_4$, and it may be mixed with the tack at an approximate ratio of 1:1 by weight. The asphalt patch preferably comprises a mixture of asphalt and aggregate and is relatively non-lossy so that a substantial portion of the applied microwave energy penetrates through the asphalt patch to heat the composite tack layer effectively. For example, the asphalt patch may preferably absorb 0.5 dB or less of the microwave energy per inch of thickness. It is preferable that the composite tack layer be heated to the range from 200° F.-250° F.

With such arrangement and method, the asphalt patch on top of the composite tack remains relatively non-lossy because lossy microwave material is not added to the asphalt patch. As a result, a substantial portion of the applied microwave radiation penetrates through the asphalt patch and is available to rapidly and effectively heat the composite tack layer to a suitable bonding temperature. For example, even if the weather conditions are relatively cold such as would be experienced in the northern states during winter, the composite tack layer is heated to a hot temperature thereby enabling a good bond between the asphalt patch and the surface of the pothole. A good bond at the interface is an important factor in providing pothole patches that are permanent and do not separate with the passage of time.

BRIEF DESCRIPTION OF THE DRAWINGS

The foregoing objects and advantages will be more fully understood by reading the Description of the Preferred Embodiments with reference to the drawings wherein:

FIG. 4 shows the step of applying microwave energy.

DESCRIPTION OF THE PREFERRED EMBODIMENTS

Figure 1:
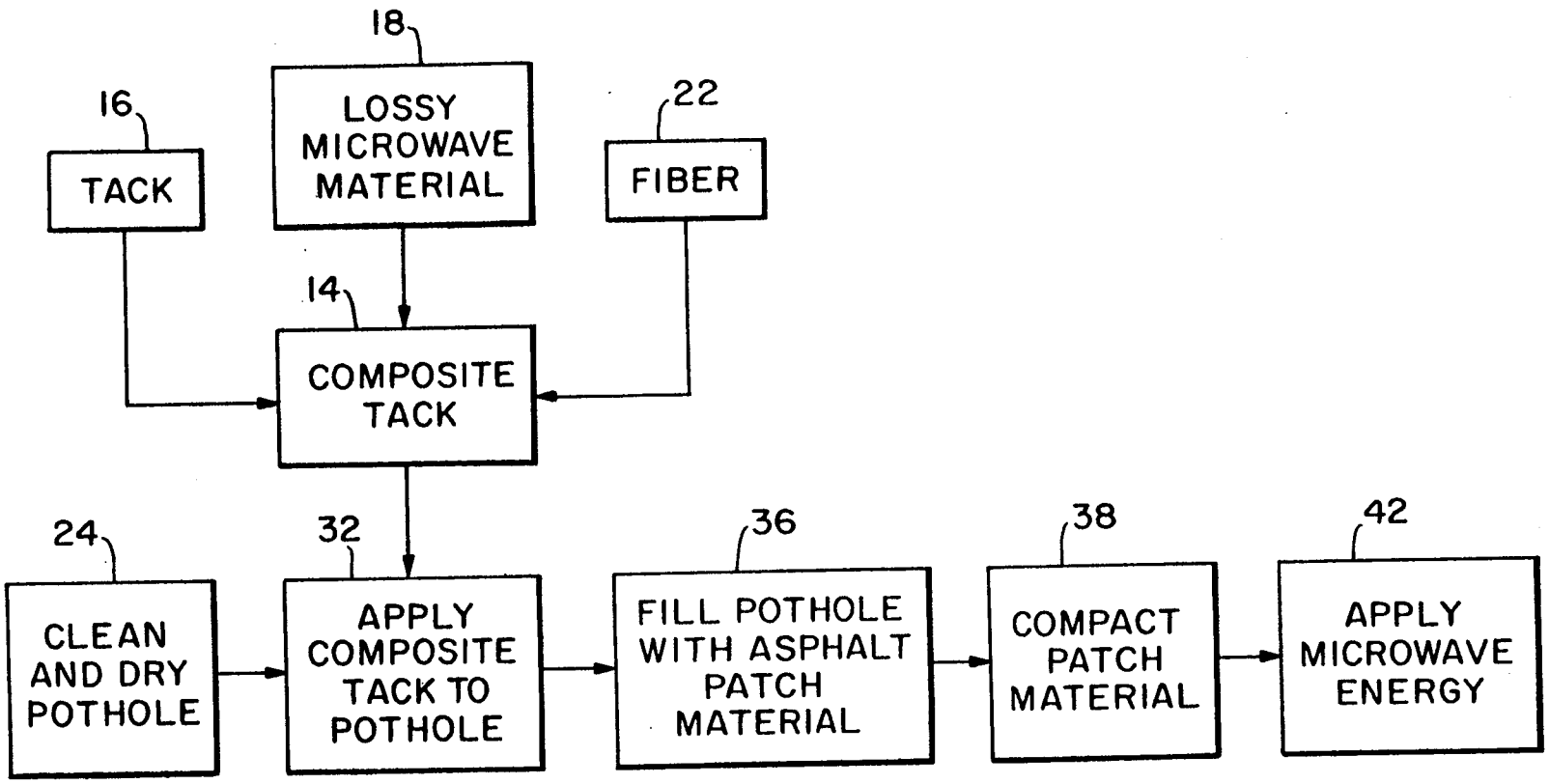
FIG. 1 is a flow chart illustrating the method of fabricating composite tack and patching a pothole in asphalt pavement.

Referring to FIG. 1, the first step in repairing a void 10 (FIG. 2A) in an asphalt pavement 12 or surface in accordance with the invention is to prepare the composite tack 14. This is done by mixing a suitable tack 16 with a lossy microwave material 18 so that, as will be described later herein, the composite tack 14 will efficiently heat in situ when radiated with microwave energy. Tack 16 is here used in its broadest sense and includes any paving material that is suitable to being put down as an adhesive or bonding layer before the void 10 or pothole is filled with a patch material 20 (FIG. 2C). That includes, but is not limited to, conventional tack materials such as bitumen or asphalt, petrochemical mixtures, polymeric mixtures, and other mixtures used to repair roadways. Generally, asphalt tack has minimal susceptibility to being heated by microwave energy. That is, asphalt tack is generally a non-lossy material. Therefore, a lossy microwave material 18 is added to the tack 16 so that it will readily and effectively be heated in accordance with the inventive process.

Lossy microwave materials are those materials which, when exposed to microwave radiation, tend to absorb that radiation thereby causing the material to be heated in an effective and efficient manner. As is well known to those skilled in the art, there are many different types of materials that are microwave lossy, and they tend to couple to the electric component, the magnetic component, or both components of the microwave energy using various combinations of mechanisms. For example, such mechanisms include dielectric loss, magnetic loss, and resistive conductivity loss. Although not all inclusive, lossy microwave materials 18 used for composite tack 14 may generally be categorized as ferromagnetic materials, dielectric materials, and good or poor conductor particles of suitable dimensions and conductivity. Examples of lossy materials are zinc oxide, iron, powdered iron, iron oxide, ferrites including spinnel ferrites, aluminum, chromium oxide, magnesium oxide, nickel oxide, carbon, and graphite.

Although the above listed and many other suitable lossy materials could be used to increase the absorbtivity or susceptibility of the composite tack 14 to heating when exposed to microwave energy, a preferred additive of lossy microwave material 18 is $Fe_3O_4$. It is relatively inexpensive, mixes easily with tack 16, and is very lossy. Further, it is a ferromagnetic material with a Curie point that may be used in certain applications to limit or control the temperature to which composite tack 14 heats. More specifically, $Fe_3O_4$ couples to the magnetic component of the microwave energy and heats largely by hystersis losses. When $Fe_3O_4$ reaches its Curie temperature, it becomes a paramagnetic material and therefore, coupling to the magnetic field and resulting heating greatly reduces. In one illustrative mixture, 50% by weight of $Fe_3O_4$ is mixed with 50% of asphalt tack 16. Although the absorbtivity or lossiness of the composite tack 14 may generally be altered by changing the mixture ratios, cost benefits will normally be taken into consideration in arriving at a preferred mixture for a particular application. Typically, the tack 16 is heated before mixing in the lossy microwave material 18 so as to lower the viscosity of the tack 16 to provide easier and more efficient mixing.

Optionally, fiber 22 can be added to form composite tack 14. Such fibers 22 preferably have a length of less than 2" and a thickness of less than ⅛ of an inch, and more preferably less than 1/16 of an inch. Fibers 22 may enhance the mechanical strength of the composite tack 14 thereby improving the bond, and also they may provide re-enforcement for the asphalt patch 20. In one embodiment, the fibers 22 can be non-lossy material such as polyester or fiberglass that are optionally added in addition to lossy microwave material 18 merely to increase the mechanical strength of composite tack 14. In an alternate embodiment, fibers 22 can be made of material such as metal or carbon of suitable size and conductivity such that in addition to providing mechanical strength, they also function as the lossy microwave material 18. The fibers 22, whether lossy or non-lossy, can be woven into threads and used in a thread form; the threads can also be woven into mesh, mat, or weaved fiber format.

Figure 2A:
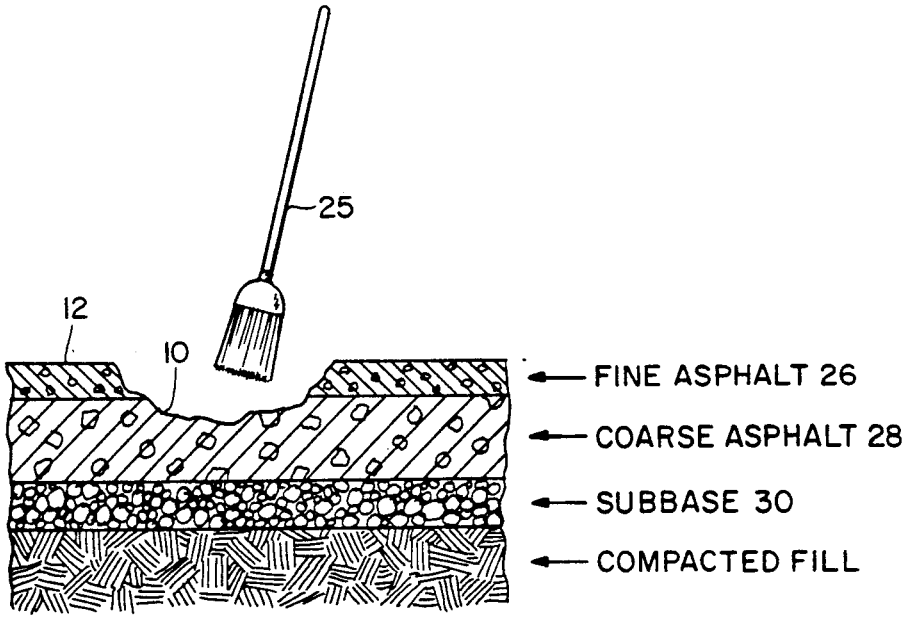
FIG. 2A shows the step of cleaning the pothole.

Referring still to FIG. 1 and also to FIG. 2A, step 24 is to CLEAN AND DRY POTHOLE as to provide a surface more suitable for bonding. Typically, water and loose road material such as gravel or other debris are removed using a broom 25 or other suitable implement. The pothole 10 may be cleaned by spraying a liquid such as salt water into the void. Then, the surface of the pothole 10 can be dried and heated such as by using a hot air blower or heating it with a gas flame burner. Although the pothole 10 shown in FIG. 2A has a depth down through fine asphalt layer 26 into coarse asphalt layer 28, it is understood that the principles of the invention will also apply for repairing a variety of different surface voids in paved surfaces. For example, the void could be shallower as only penetrating the fine asphalt layer 26, deeper down into the subbase 30, or could take a different form such as a crack or an entire road section that has been scarified.

Figure 2B:
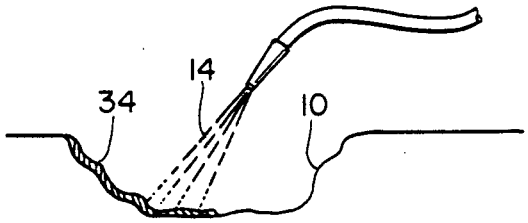
FIG. 2B shows the step of applying the composite tack to the pothole.
Figure 2C:
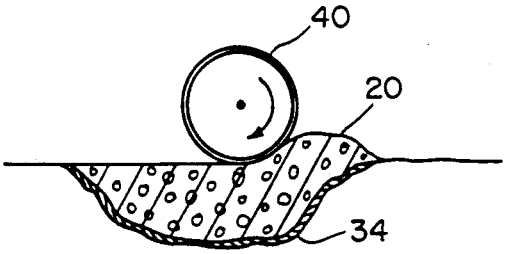
FIG. 2C illustrates the pothole being filled with asphalt patch and being compacted.

Still referring to FIG. 1 and also to FIG. 2B, step 32 is to APPLY COMPOSITE TACK TO POTHOLE. The composite tack 14 may typically be applied by spraying as shown, or by brushing. The desired thickness of composite tack 14 may depend on the particular application, but a thickness of approximately 1/16 of an inch is generally suitable. Although the layer 34 of composite tack 14 will be subsequently heated with microwave energy as will be described later, it is preferable that composite tack 14 be heated by conventional manner before being applied to pothole 10 so that it will have a low viscosity and will spread more evenly and easily.

Still referring to FIG. 1 and also to FIG. 2C, step 36 is to FILL POTHOLE WITH ASPHALT PATCH MATERIAL. Typically, asphalt patch material 20 is a mixture of bitumen or other petrochemical mixture combined with rock, gravel, crushed stone, or pebbles. These rocks, gravel, etc. may be in a powder form or may, depending on the particular application, have a dimension of as much as 1.5".

Still referring to FIGS. 1 and 2C, step 38 is to COMPACT PATCH MATERIAL typically using a manual compactor or a roller 40 so that the upper surface is approximately level or flush with the asphalt surface 12.

Figure 2D:
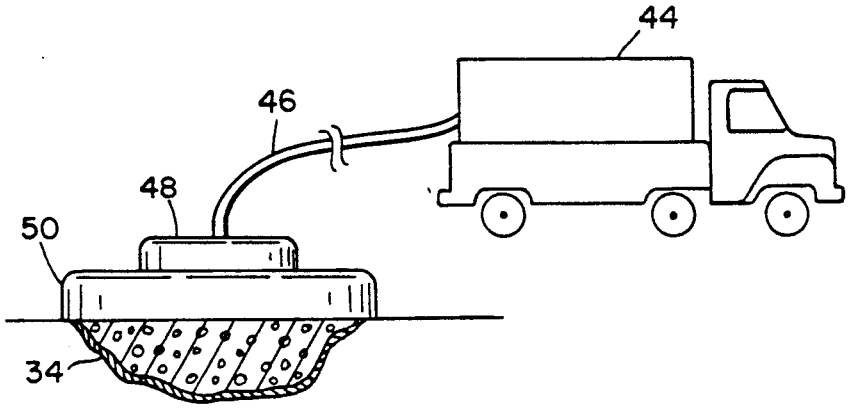

Still referring to FIG. 1 and also to FIG. 2D, step 42 is to APPLY MICROWAVE ENERGY. Microwave energy is applied by suitable apparatus, such as, for example, a mobile microwave transmitter 44 typically providing microwave energy at 915 MHz or 2450 MHz to a waveguide 46 coupled to an applicator 48 or feed having suitable shields 50 for preventing the escape of microwave energy. Although the preferred power of transmitter 44 may depend on a number of parameters such as, for example, the size of applicator 48, the frequency of transmitter 44, the type of surface 12 being repaired, the shape and depth of the voids 10 or potholes, and the lossiness of the asphalt patch 20 and composite tack 14, transmitter 44 may typically provide 2.5 Kilowatts–100 Kilowatts of microwave power. It may be preferable to heat composite tack 14 to a temperature approximately between 200° F. to 250° F. By reaching temperatures in this range, the layer 34 of composite tack 14 has a very low viscosity and functions like a hot melt glue penetrating into the asphalt patch 20 on one side and the inner surface of the pothole 10 on the other side to form a strong interface bond. If temperatures above 250° F. are reached, the asphalt in the composite tack 14 and/or in the asphalt patch 20 may smoke thereby creating an undesirable environmental condition.

The appropriate time period of microwave exposure will depend on the parameters described above, and also on the selected power level of transmitter 40. Accordingly, tests can be run on samples similar to the planned application to determine the suitable time period of exposure. Although there may be significant differences among asphalt patches 20, a typical sample may absorb 0.3 dB of 2450 MHz energy per inch of thickness. Therefore, it is approximated that with a 1:1 $Fe_3O_4$ to tack mix applied to a thickness of 1/16 of an inch, the composite tack layer 34 will heat at a rate of approximately 13° F./min/kw/sq. ft. when under asphalt patch approximately 3" thick. The calculation is based on the assumed patch absorbing 0.9 dB or 19% of the applied microwave power. As can be seen, for the assumed sample of asphalt patch 20, the thickness above the composite tack layer 34 has to vary significantly in order to have substantial effect on the temperature to which the composite tack layer 34 rises for a given duration of exposure at a given power level. During cold weather such as would experienced in northern states during the winter, heat may tend to flow rapidly away from the composite tack layer 34 by conduction as microwave energy is being applied. For this reason, a higher power transmitter 44 may be more effective because the composite tack layer will reach a suitable bonding temperature much faster partially due to the fact there is less time for generated heat to conduct away from the layer 34.

In an illustrative embodiment, applicator 48 has a 14" diameter and leakage suppression is provided by a peripheral double quarter-wave choke plus an absorbing jacket (not shown). Here, applicator 48 is fed through WR430 waveguide 46 by transmitter 44 that operates at 2450 MHz with an output power of 2 KW per square foot of applicator 48 surface area. With such apparatus, a minimum heating time of 10 minutes is predicted. In an alternate illustrative embodiment, transmitter 44 operates at 915 MHz and provides 2 KW per square foot of applicator 48 surface area into an applicator 48 having a 20–25 $ft^2$ footprint. It may also be desirable to feed a plurality of applicators 48 simultaneously to increase the size of instantaneous coverage.

In accordance with the invention, lossy microwave material 18 is added to the tack 16 to make a lossy composite tack 14 for the tack layer 34, but no lossy microwave material 18 is added to the asphalt patch 20 so it remains relatively non-lossy or transparent to microwave energy. Accordingly, a relatively small percentage of the applied or available microwave energy is absorbed by the asphalt patch 20 resulting in a higher percentage of the available microwave energy being absorbed in composite tack layer 34. Thus, the composite tack layer 34 heats up faster and to a higher temperature than it otherwise would if a larger percentage of the available microwave energy were being absorbed in the asphalt patch 20. It is important that the composite tack 14 be heated rapidly and effectively to a suitable temperature such as in the range from 200° F.– 250° F. so as to provide a good bond at the interface between the asphalt patch 20 and the inner surface of the void 10 or pothole. This heat in the composite tack layer 34 and the resulting dependent quality of the bond is a critical factor in obtaining a good permanent repair. Further, by applying the lossy microwave material 18 to composite tack 14 for the composite tack layer 34 rather than to the asphalt patch 20, the required quantity and thus cost of the lossy microwave material 18 is substantially less.

What is claimed is:

1. A method of repairing a void in asphalt pavement comprising the steps of:

mixing a lossy microwave material with a tack to form a lossy composite tack;

applying said composite tack to the surface of said void to form a layer having a thickness of ⅛ inch or less;

filling said void on top of said composite tack layer with an asphalt patch which is non-lossy relative to said composite tack; and applying microwave energy for a predetermined time period to the upper surface of said asphalt patch wherein a substantial portion of said microwave energy penetrates through said asphalt path and is absorbed by said lossy microwave material in said lossy composite tack to heat said composite tack layer to form an interface bond between said asphalt patch and said surface of said void.

2. The method recited in claim 1 further comprising a step of heating said tack before mixing in said lossy microwave material to form said lossy composite tack.

3. The method recited in claim 1 further comprising a step of heating said asphalt patch before filling said void.

4. The method recited in claim 1 further comprising a step of cleaning and drying said void before applying said composite tack.

5. The method recited in claim 1 further comprising a step of adding fibers to form said composite tack.

6. The method recited in claim 1 wherein said lossy microwave material is $Fe_3O_4$.

7. A method of repairing a void in asphalt pavement comprising the steps of:

mixing a lossy microwave material comprising $Fe_3O_4$ with a tack to form a lossy composite tack wherein said $Fe_3O_4$ is mixed with said tack at an approximate ratio 1:1 by weight;

applying said composite tack to the surface of said void to form a layer having a thickness of 1" or less;

filling said void on top of said composite tack layer with an asphalt patch; and applying microwave energy for a predetermined time period to the upper surface of said asphalt patch wherein a substantial portion of said microwave energy penetrates through said asphalt patch and is absorbed by said lossy microwave material in said lossy composite tack to heat said composite tack layer to form an interface bond between said asphalt patch and said surface of said void.

8. The method recited in claim 1 wherein said composite tack layer has a thickness of 1/16" or less.

9. The method recited in claim 1 wherein said asphalt patch comprises a mixture of asphalt and aggregate.

10. The method recited in claim 1 wherein said asphalt patch is non-lossy.

11. The method recited in claim 10 wherein said asphalt patch absorbs less than 0.5 dB of said microwave energy per inch of said asphalt patch.

12. The method recited in claim 1 wherein said microwave energy is applied at a power level that heats said composite tack layer to the range from 200° F.-250° F. in said predetermined time period.

13. A composite for paving comprising, in combination:

a mixture of tack and a lossy microwave material dispersed in said tack for enhancing heating of said mixture when said mixture is exposed to microwave radiation, said lossy material comprising $Fe_3O_4$ mixed with said tack at an approximate ratio of 1:1 by weight.

* * * * *